US005197226A

United States Patent [19]

Gayhart, Jr. et al.

[11] Patent Number: 5,197,226

[45] Date of Patent: Mar. 30, 1993

[54] ACCESS DOOR WITH SAFETY LATCH FOR PRESSURIZED AIR CHAMBERS

[75] Inventors: Edward E. Gayhart, Jr., North Canton; John W. Coursen, Copley; Dwight R. Kirk, Massillon, all of Ohio

[73] Assignee: The Babcock & Wilcox Company, New Orleans, La.

[21] Appl. No.: 735,568

[22] Filed: Jul. 25, 1991

[51] Int. Cl.[5] ..... E05B 65/06

[52] U.S. Cl. ..... 49/394; 292/241

[58] Field of Search ..... 49/394; 292/116, 120, 292/241, DIG. 14, DIG. 65, DIG. 72

[56] References Cited

U.S. PATENT DOCUMENTS

| | | | |
|---|---|---|---|
| 1,466,528 | 8/1923 | Holmes | 292/241 |
| 2,545,886 | 3/1951 | Kooistra . | |
| 2,775,216 | 12/1956 | Alexeff et al. . | |
| 2,920,585 | 1/1960 | Grossman et al. . | |
| 3,039,837 | 6/1962 | Poe | 292/241 X |
| 3,055,321 | 9/1962 | Fitz Patrick . | |
| 3,217,661 | 11/1965 | Kemp | 292/241 X |
| 3,479,994 | 11/1969 | Kreider et al. . | |
| 3,560,038 | 2/1971 | Gunther | 292/241 |
| 3,781,162 | 12/1973 | Rudd et al. . | |
| 3,893,722 | 7/1975 | Galbreath et al. | 292/100 |
| 3,966,244 | 6/1976 | Kleisser et al. | 292/DIG. 14 |
| 4,674,777 | 6/1987 | Guelck | 292/241 X |

*Primary Examiner*—Peter M. Cuomo
*Assistant Examiner*—Jerry Redman
*Attorney, Agent, or Firm*—Robert J. Edwards

[57] ABSTRACT

An access door assembly for a pressurized windbox, comprising a door frame having an opening with a post extending from the door frame. A door is pivotally mounted to the frame at a hinge. A latch is pivotally mounted to the door and includes a hook which engages the post for locking the door to the frame. The latch also includes a catch member extending beyond the hook for catching the post when the latch is moved to unlock the door. This stops the door in an intermediate partly open position allowing gusts of air to blow through the opening thereby giving the operator a warning and indication that the windbox is in fact under pressure. In this manner, an operator has sufficient time to step out of the way before moving the latch further, thereby fully disengaging the latch from the post and allowing the door to open fully.

3 Claims, 3 Drawing Sheets

ACCESS DOOR WITH SAFETY LATCH FOR PRESSURIZED AIR CHAMBERS

FIELD AND BACKGROUND OF THE INVENTION

The present invention relates, in general, to access doors for pressurized air chambers such as boiler windboxes and, more particularly, to a new and useful access door with a safety catch feature which alerts the boiler operator that the windbox is under pressure.

Windboxes are used in boilers to supply preheated air. U.S. Pat. No. 3,479,994 discloses a wraparound windbox for this purpose. Another windbox arrangement is disclosed in U.S. Pat. No. 3,781,162.

FIGS. 1 and 2 are respective front and side elevation views of a known access door for boilers and comprises a frame 10 defining an opening into the boiler space, and a door 12 connected to the frame at a hinge 14 for movement of the door on the frame between a closed position, covering the opening, and an open position, spaced away from the opening (not shown). A C-shaped latch 16 having a heat dissipating handle 18, is pivotally mounted, at pins 20, to opposite sides of the door 12. To lock the door in the closed position shown in FIGS. 1 and 2, latch 16 is pivoted in the direction of arrow A so that a pair of hooks 22, on opposite sides of the latch, engage a pair of trunnions or posts 24 extending from opposite sides of the housing 10. If a chamber outfitted with the door of FIGS. 1 and 2 is under pressure, door 12 will open rapidly once latch 16 is moved in a direction opposite to arrow A, for unlocking the door.

The air within the windbox is normally under elevated pressure and at a temperature of around 400° F. Under these conditions, access doors into the windbox need not be cooled. A dangerous condition may arise, however, when a boiler operator attempts to open an access door to a windbox, which is under pressure, without stepping aside as gusts of hot air will blow through the open door.

A variety of furnace access doors are known which include cooling and specialized latches. Cooling is necessary since combustion gases within the furnace may be as high as 2000° F. See, for example, U.S. Pat. Nos. 2,545,886; 2,775,216; 2,920,585; and 3,055,321.

A need remains for a windbox access door construction which provides the operator with a warning that the windbox is under pressure, and a mechanism to prevent the door from swinging open rapidly under these conditions.

SUMMARY OF THE INVENTION

An object of the present invention is to provide an access door assembly for a pressurized air chamber that includes a safety latch mechanism which automatically catches the door in a slightly open position. The air pressure in the chamber will cause gusts of air to blow through the partially-opened door thereby giving the operator a warning and indication that the chamber is in fact under pressure, and further, allowing sufficient time for the operator to move out of the way. To fully open the door, the operator must further manipulate the safety latch mechanism to release the door so that it can be fully opened.

A further object of the present invention is to provide an access door assembly for a pressurized air chamber, comprising: a door frame defining an opening and having at least one projection; a door movably mounted with respect to the frame, along a path between a closed position, closing the opening, and an opened position, spaced away from the opening; and a latch movably mounted to the door, into a locked position engaging the projection when the door is in its closed position, and into an unlocked position disengaging the projection for allowing the door to move toward the opened position, the latch including catch means for engaging the projection as the door moves along the path and into an intermediate, slightly open, position spaced away from the opening, the latch being further movable to disengage the catch means from the projection for allowing the door to move along the path into the open position.

A further object of the present invention is to provide an access door assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENT

Figure 2:
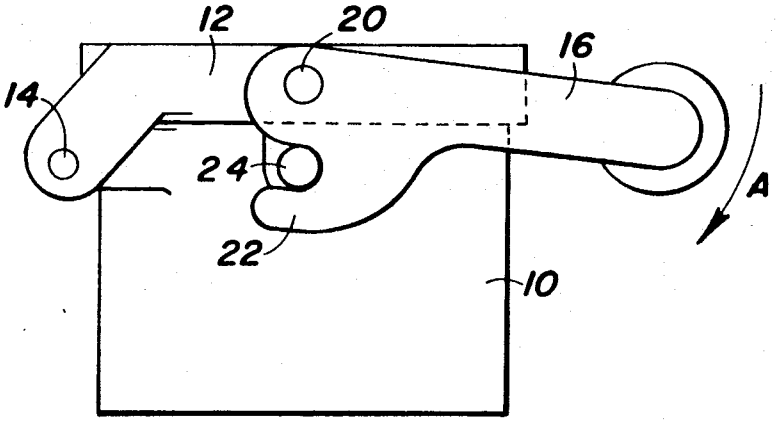
FIG. 2 (PRIOR ART)
FIG. 2 is a side elevation view of the access door of FIG. 1.
Figure 3:
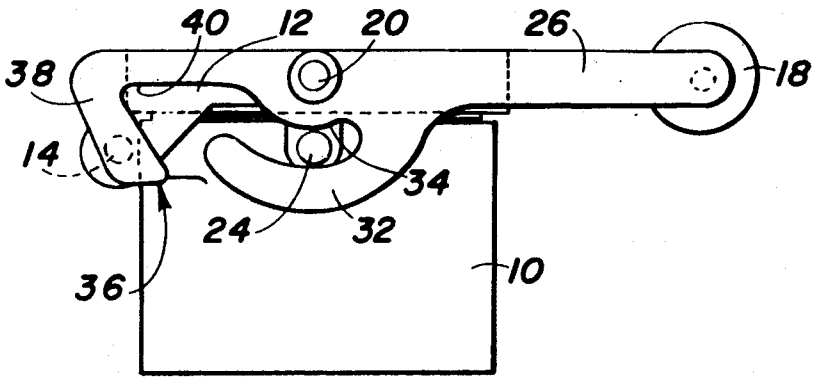
FIG. 3 is a side elevation view of the access door assembly of the present invention with the door in a closed position.
Figure 1:
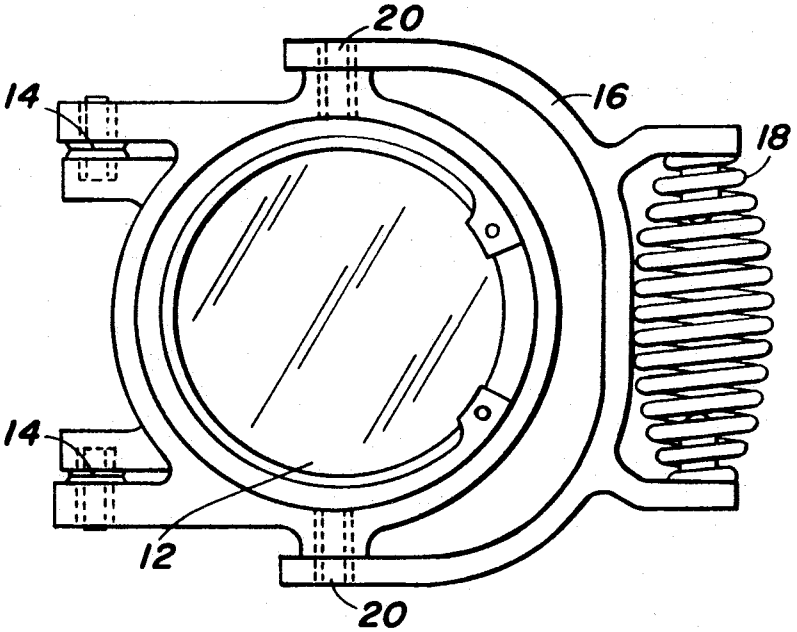
FIG. 1 (PRIOR ART)
FIG. 1 is a front elevation view of an access door for a pressurized chamber according to the prior art.

Referring to FIGS. 3 through 8, where the same reference numerals are utilized to designate the same functionally similar parts, the present invention comprises a door assembly including a door frame 10 which is adapted for mounting to a pressurized chamber such as a windbox (not shown). A door 12 is pivotally mounted at hinge 14 to the frame 10 for closing and opening of the frame in the position of the door shown in FIG. 3. In this position, the door is locked to the frame by a latch 26, which is pivotally mounted at a pivot connection 20 to the door 12. Pivot connection 20 is spaced away from the hinge 14 so that as the door opens along a path from its closed position to its open position, the pivot connection 20 and the latch 26 also move along this path.

Latch 26 includes a curved hook 32 that defines an arcuate locking recess 34 which traps the post or projection 24 of the frame 10, for locking door 12 in its closed position.

In accordance with the present invention, latch 26 includes catch means 36 in the form of a hook-like V-shaped catch member 38 defining a catch recess 40 which traps the projection 24 as will be explained in connection with FIGS. 4 and 5. The catch member 38 is on an opposite side of the pivot connection 20, from the hook 32, as shown in FIGS. 3–8.

Figure 4:
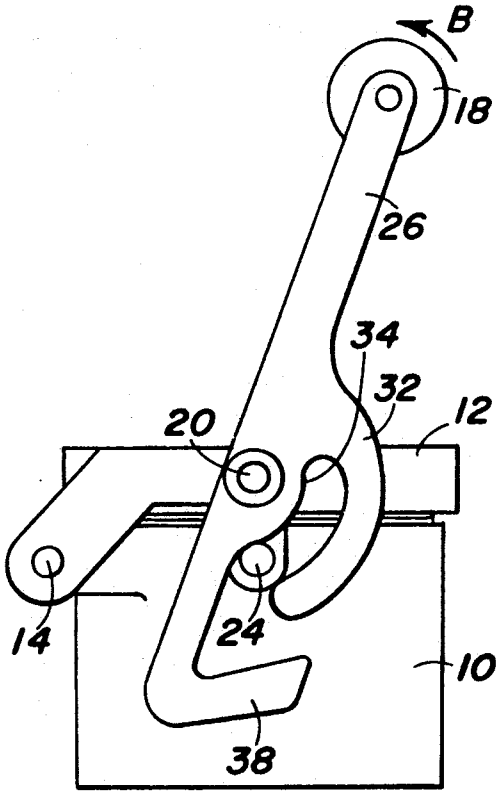
FIG. 4 is a view similar to FIG. 3 showing the latch of the door assembly moving toward an unlocked position.

To open access door 12, the boiler operator grasps handle 18 and pivots latch 26 on pivot connection 20 in the direction of arrow B shown in FIG. 4. As the latch is pivoted, hook 32 slides along the projection 24 until the projection clears the locking recess 34 as shown in FIG. 4. At this point, if the chamber equipped with the access door of the present invention is under pressure, pressurized air will escape at C as shown in FIG. 5, forcing door 12 along its path of movement from its closed position toward its open position. Since the pivot connection 20 and latch 26 also move along this path, catch member 38 quickly engages the projection 24 and finds itself in the catch recess 40. Door 12 is thus stopped in an intermediate partly open position shown in FIG. 5. To ensure that the projection 24 is seated in the deepest part of catch recess 40, catch member 38 has an inclined entry surface 42 along which projection 24 may slide.

Figure 6:
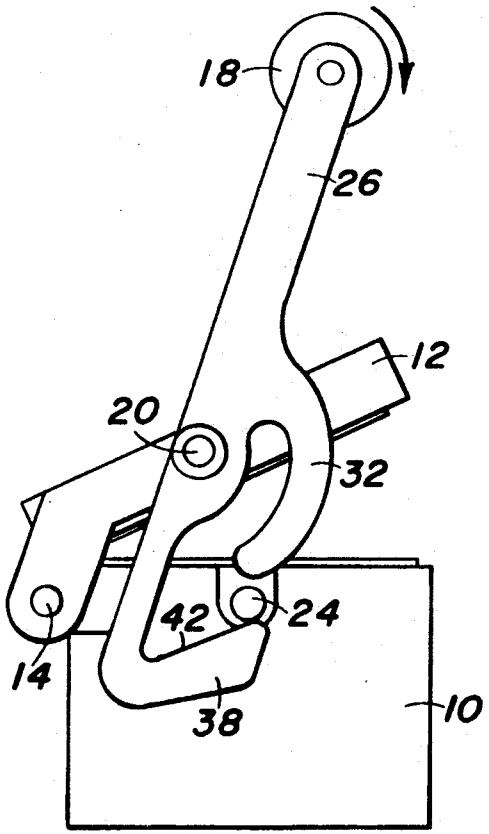
FIG. 6 is a view similar to FIG. 3 showing additional movement of the latch which is required for disengaging the catch in preparation for fully opening the door.
Figure 5:
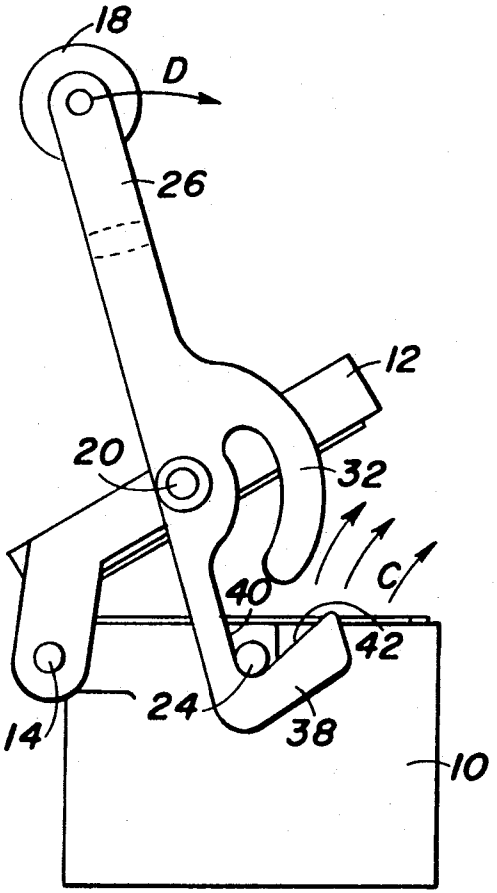
FIG. 5 is a view similar to FIG. 3 showing the latch in an unlocked position but with the door caught by a catch mechanism in an intermediate, slightly opened position.

The operator is now given an opportunity to step out of the way before he moves latch 26 in the direction of arrow D in FIG. 5 which is opposite to the first direction of arrow B, as shown at FIG. 4. As shown in FIG. 6, this causes projection 24 to slide along inclined surface 42 and out through a recess exit passage 44 between the free end of the catch member 38 and the free end of the hook 32. The exit passage is slightly larger than the diameter of projection 24.

Figure 8:
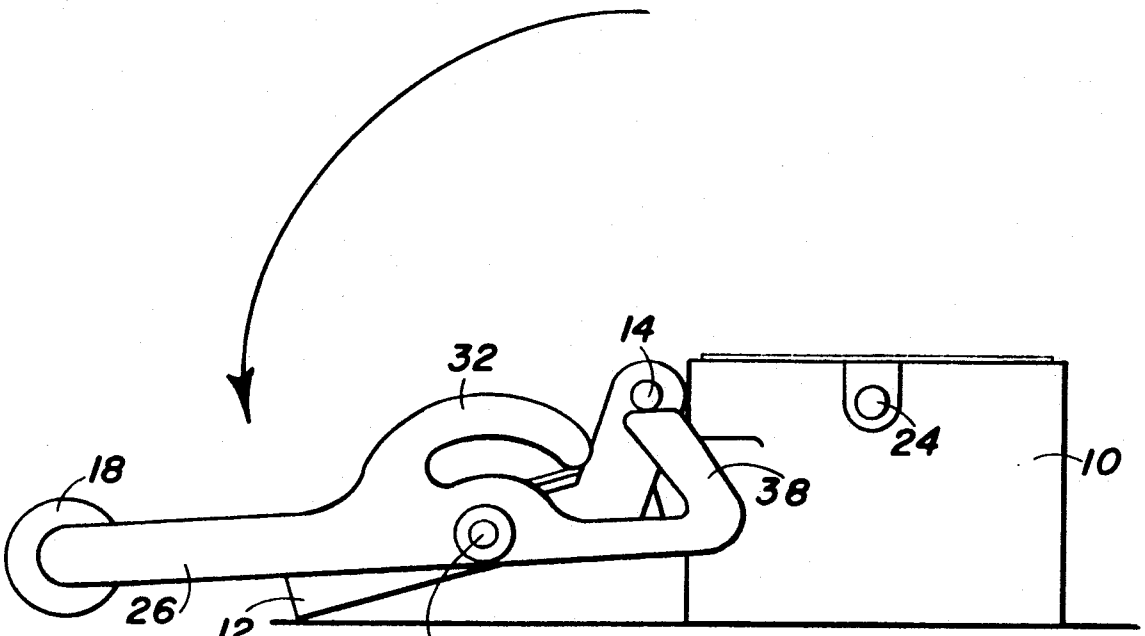
FIG. 8 is a view similar to FIG. 3 with the door in its fully opened position.
Figure 7:
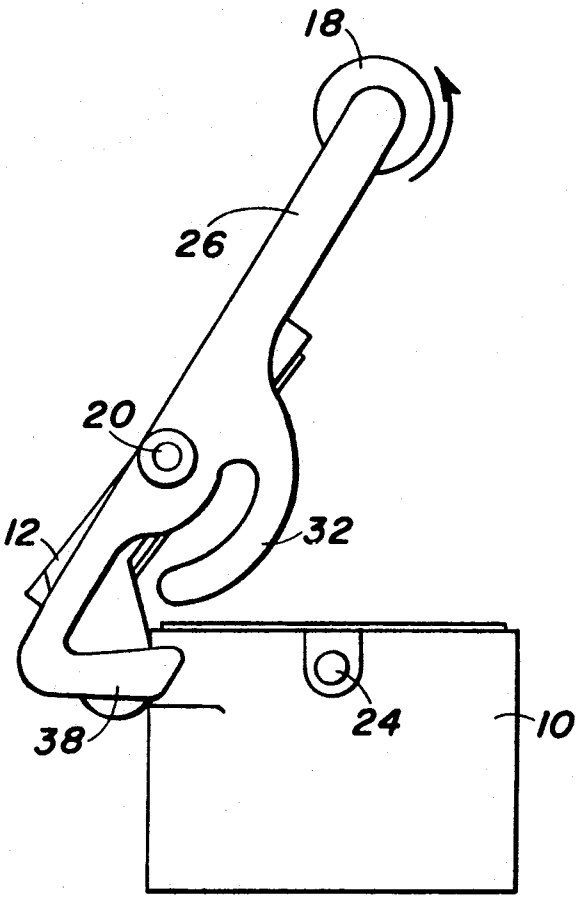
FIG. 7 is a view similar to FIG. 3 with the door approaching its fully opened position.

With latch 26 now fully clear from projection 24 as shown in FIG. 7, door 12 can be swung into its fully opened position shown in FIG. 8.

While a specific embodiment of the invention has been shown and described in detail to illustrate the application of the principles of the invention, it will be understood that the invention may be embodied otherwise without departing from such principles.

What is claimed is:

1. An access door assembly for a boiler windbox, comprising:

a door frame defining an opening;

a post connected to the door frame;

a door pivotally mounted to the door frame at a hinge and movable along an arcuate path between a closed position, closing the opening, and an open position, spaced away from the opening; and a latch pivotally mounted to the door at a pivot connection which is spaced away from the hinge, the latch being movable in a first direction between a locked position which engages the post when the door is in the closed position, and an unlocked position which disengages the post allowing the door to move away from the closed position, the latch including a catch member for engaging the post as the door moves along the path with the latch in an unlatched position for stopping the door at an intermediate, partly open position, the latch being further movable in an opposite direction to said first direction to disengage the catch member from the post to allow the door to continue its movement toward the open position, the latch including a hook defining an arcuate locking recess for receiving the post in the locked position of the latch, the catch member defining a catch recess with an inclined surface spaced away from the arcuate locking recess and for receiving the post, the hook and catch members being spaced from each other and defining an exit passage through which the post is movable with movement of the latch in the opposite direction, to disengage the latch and catch members completely from the post.

2. An assembly according to claim 1, wherein the catch member is at one end of the latch, and a handle connected to an opposite end of the latch, the catch member being adjacent the hinge when the latch is in a locked position and the door is in a closed position.

3. An assembly according to claim 1 wherein the catch member is V-shaped and extends from the latch on one side of the pivot connection, the hook extending from the latch on an opposite side of the pivot connection.

* * * * *